US010080479B2

(12) United States Patent
Chamarthi et al.

(10) Patent No.: US 10,080,479 B2
(45) Date of Patent: Sep. 25, 2018

(54) LOWER RACK ASSEMBLY FOR DISHWASHER APPLIANCE

(71) Applicant: General Electric Company, Schenectady, NY (US)

(72) Inventors: Sai Krishna Chamarthi, Khanapuram Haveli (IN); Ashutosh Kulkarni, Karnataka (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 400 days.

(21) Appl. No.: 14/997,635

(22) Filed: Jan. 18, 2016

(65) Prior Publication Data

US 2017/0202427 A1 Jul. 20, 2017

(51) Int. Cl.

| | |
|---|---|
| ***A47L 15/50*** | (2006.01) |
| ***A47L 15/42*** | (2006.01) |
| ***A47L 15/23*** | (2006.01) |

(52) U.S. Cl.

CPC ..... *A47L 15/506* (2013.01); *A47L 15/23* (2013.01); *A47L 15/4261* (2013.01); *A47L 15/4293* (2013.01); *A47L 15/502* (2013.01); *A47L 15/507* (2013.01)

(58) Field of Classification Search

None

See application file for complete search history.

(56) References Cited

U.S. PATENT DOCUMENTS

| | | | | |
|---|---|---|---|---|
| RE22,936 | E | 5/1940 | Wilson | |
| 3,390,930 | A | 7/1968 | Peterson | |
| 3,822,085 | A * | 7/1974 | Clark | A47L 15/504 312/311 |
| 5,115,822 | A | 5/1992 | Nichols | |
| 5,657,878 | A | 8/1997 | Austin | |
| 5,971,513 | A | 10/1999 | Cassalia | |
| 6,247,771 | B1 | 6/2001 | Miller | |
| 6,510,858 | B1 | 1/2003 | Halstead et al. | |
| 7,621,605 | B2 | 11/2009 | Bond et al. | |
| 7,731,805 | B2 | 6/2010 | Banta et al. | |
| 8,162,419 | B2 | 4/2012 | Dellby et al. | |
| 8,303,053 | B2 | 11/2012 | Bond et al. | |
| 2004/0244825 | A1 | 12/2004 | Ashton | |

FOREIGN PATENT DOCUMENTS

| | | | |
|---|---|---|---|
| EP | 1066789 | A1 | 6/2000 |
| EP | 1066789 | B1 | 4/2004 |
| JP | H10179495 | A1 | 7/1998 |
| JP | 4469250 | B2 | 5/2010 |

* cited by examiner

*Primary Examiner* — Rita P Adhlakha

(74) *Attorney, Agent, or Firm* — Dority & Manning, P.A.

(57) ABSTRACT

A lower rack assembly for a dishwasher appliance includes a lower rack configured for receipt of articles for washing, and a lift assembly connected to the lower rack. The lift assembly includes a first arm extending between a first end and a second end, the first end of the first arm pivotally coupled to the lower rack, and a first bracket defining a first slot, the second end of the first arm movably coupled to the first slot. Movement of the lower rack along the vertical direction causes movement of the second end of the first arm relative to the first slot along the transverse direction and pivotal rotation of the first end of the first arm.

16 Claims, 8 Drawing Sheets

LOWER RACK ASSEMBLY FOR DISHWASHER APPLIANCE

FIELD OF THE INVENTION

The present subject matter relates generally to dishwasher appliances, and more particularly to lower rack assemblies for use in dishwasher appliances.

BACKGROUND OF THE INVENTION

Dishwasher appliances generally include a tub that defines a wash chamber. Rack assemblies can be mounted within the wash chamber of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

Typically, the lower rack of a dishwasher is pulled out from the wash chamber for loading and unloading of dishes. A dishwasher door pivots into an open, generally horizontal position and may define a surface having one or more tracks for receiving wheels rotatably mounted on the lower rack. The lower rack is rolled out of the tub onto the open dishwasher door to simplify the loading or unloading process, e.g., by not requiring a user to reach into the wash chamber to add or remove dishes. However, even when the rack is extended outside the wash chamber, consumers must often bend over to reach the dishes located in the lower rack, resulting in discomfort and ergonomic issues. While some dishwashers have incorporated means for lifting the lower rack, these mechanisms often lift the lower rack in a jerky and non-uniform manner. Alternatively, these systems are complex, expensive, and difficult to maintain.

Accordingly, a dishwashing appliance having apparatus for lifting the lower rack when loading or unloading dishes would be useful. More particularly, cost effective rack lifting apparatus that may lift the lower rack in a smooth and uniform manner to provide a simple, ergonomic method of loading and unloading dishes would be advantageous.

BRIEF DESCRIPTION OF THE INVENTION

In accordance with one embodiment, a dishwasher appliance defining a vertical, a lateral, and a transverse direction is provided. The dishwasher appliance includes a wash tub that defines a wash chamber, a fluid circulation assembly for providing a fluid flow within the wash chamber, and a lower rack assembly. The lower rack assembly includes a lower rack configured for receipt of articles for washing, and a lift assembly connected to the lower rack. The lift assembly includes a first arm extending between a first end and a second end, the first end of the first arm pivotally coupled to the lower rack, and a first bracket defining a first slot, the second end of the first arm movably coupled to the first slot. Movement of the lower rack along the vertical direction causes movement of the second end of the first arm relative to the first slot along the transverse direction and pivotal rotation of the first end of the first arm.

In accordance with another embodiment, a lower rack assembly for a dishwasher appliance is provided. The lower rack assembly includes a lower rack configured for receipt of articles for washing, and a lift assembly connected to the lower rack. The lift assembly includes a first arm extending between a first end and a second end, the first end of the first arm pivotally coupled to the lower rack, and a first bracket defining a first slot, the second end of the first arm movably coupled to the first slot. Movement of the lower rack along the vertical direction causes movement of the second end of the first arm relative to the first slot along the transverse direction and pivotal rotation of the first end of the first arm.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
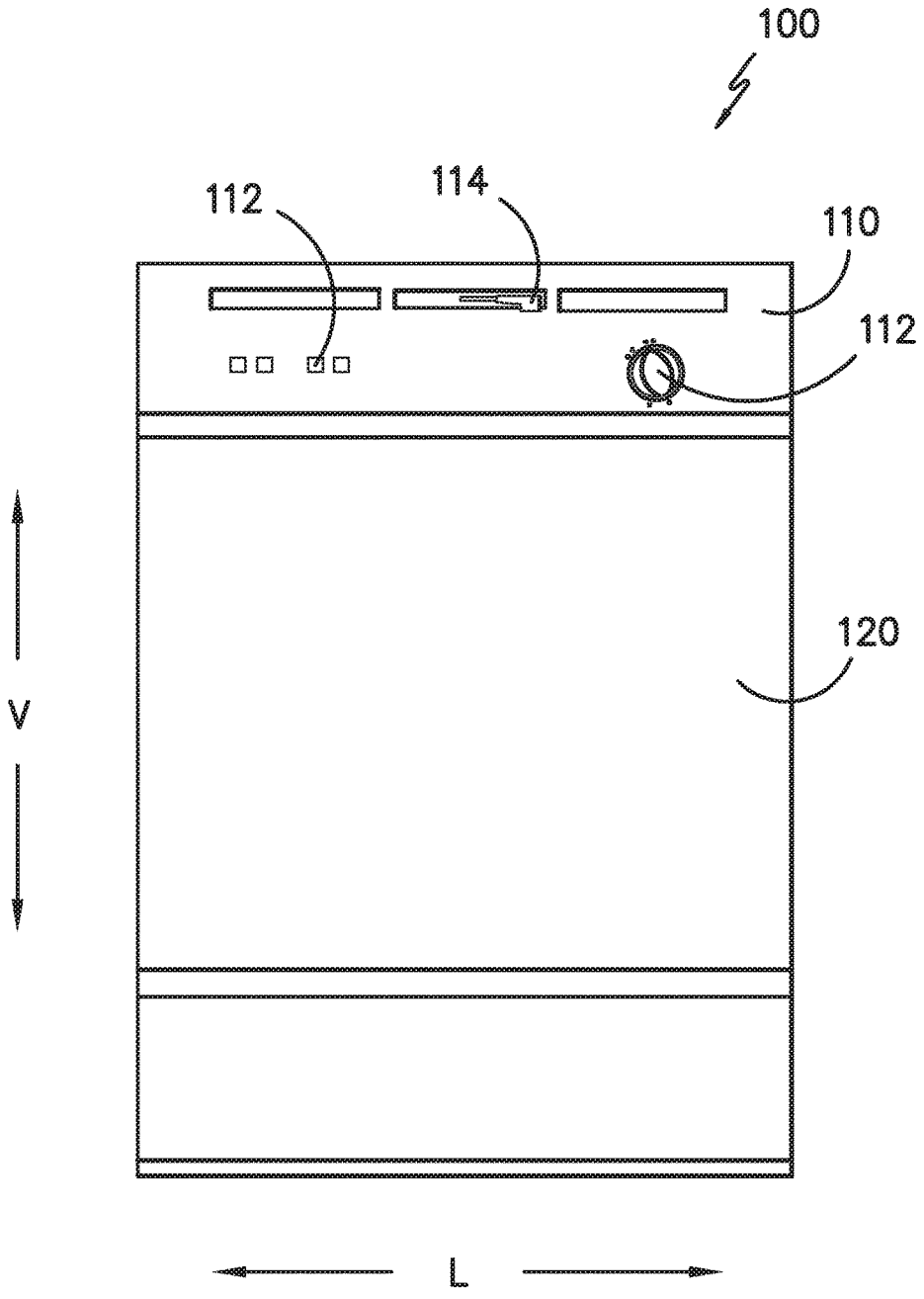
FIG. 1 provides a front elevation view of a dishwasher appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
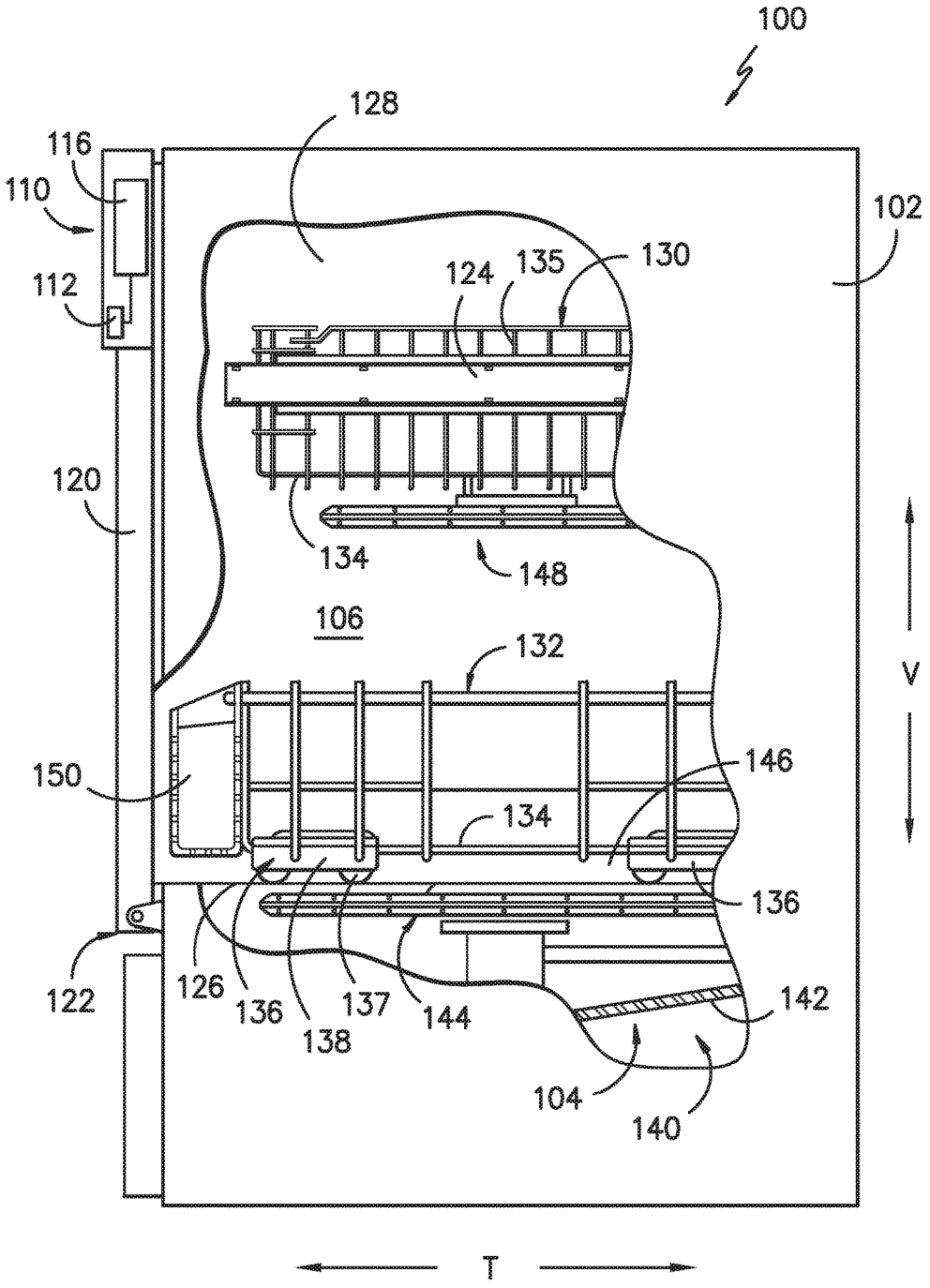
FIG. 2 provides a partial side section view of a dishwasher appliance in accordance with embodiments of the present disclosure.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack 130. Lower guides 126 are positioned in opposing manner of the sides of chamber 106 and provide a ridge or shelf for roller assemblies 136 so as to support and provide for movement of a lower rack 132. Each of the upper and lower racks 130 and 132 is fabricated into lattice structures including a plurality of elongated members 134 and 135 that extend in lateral (L), transverse (T), and/or vertical (V) directions. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower racks 130 and 132, respectively. A silverware basket 150 may be removably attached to the lower rack 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack 132. A spray arm or mid-level spray assembly 148 is located in an upper region of the wash chamber 106 and may be located in close proximity to upper rack 130. Additionally, an upper spray assembly (not shown) may be located above the upper rack 130 and mounted to an upper wall of tub 104.

Lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower racks 130, 132 and/or lower and mid-level spray assemblies 144, 148, and other differences may be applied as well.

FIGS. 3 through 8 illustrate embodiments and components of a lower rack assembly 200 in accordance with embodiments of the present disclosure. Lower rack assemblies 200 in accordance with the present disclosure advantageously facilitate lifting of the lower rack 132 as desired to, for example, load or unload articles. Further, lower rack assemblies 200 in accordance with the present disclosure may advantageously be cost effective and may facilitate lifting and lowering in a smooth, uniform and ergonomic manner.

Lower rack assembly 200 may include, for example, lower rack 132. The lower rack 132 may define an interior volume 206. In particular, a bottom wall 210, a back wall 216, a front wall 217 and side walls 218, 219 of rack assembly 200 may assist with defining interior volume 206 of rack assembly 200. Thus, interior volume 206 of rack assembly 200 may be defined between bottom wall 210, back wall 216, front wall 217 and side walls 218, 219 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Figure 3:
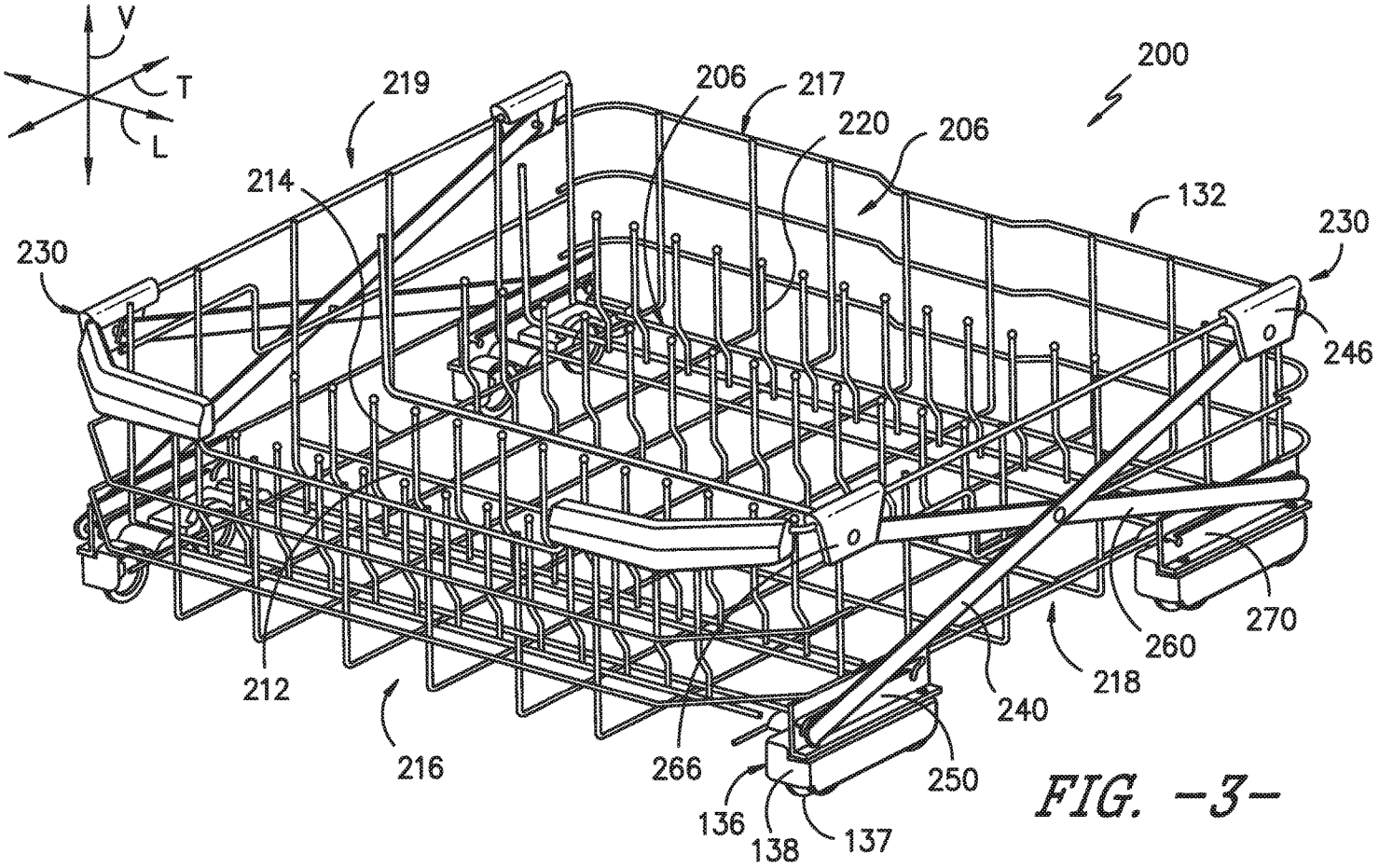
FIG. 3 provides a perspective view of a lower rack assembly in accordance with embodiments of the present disclosure.
Figure 4:
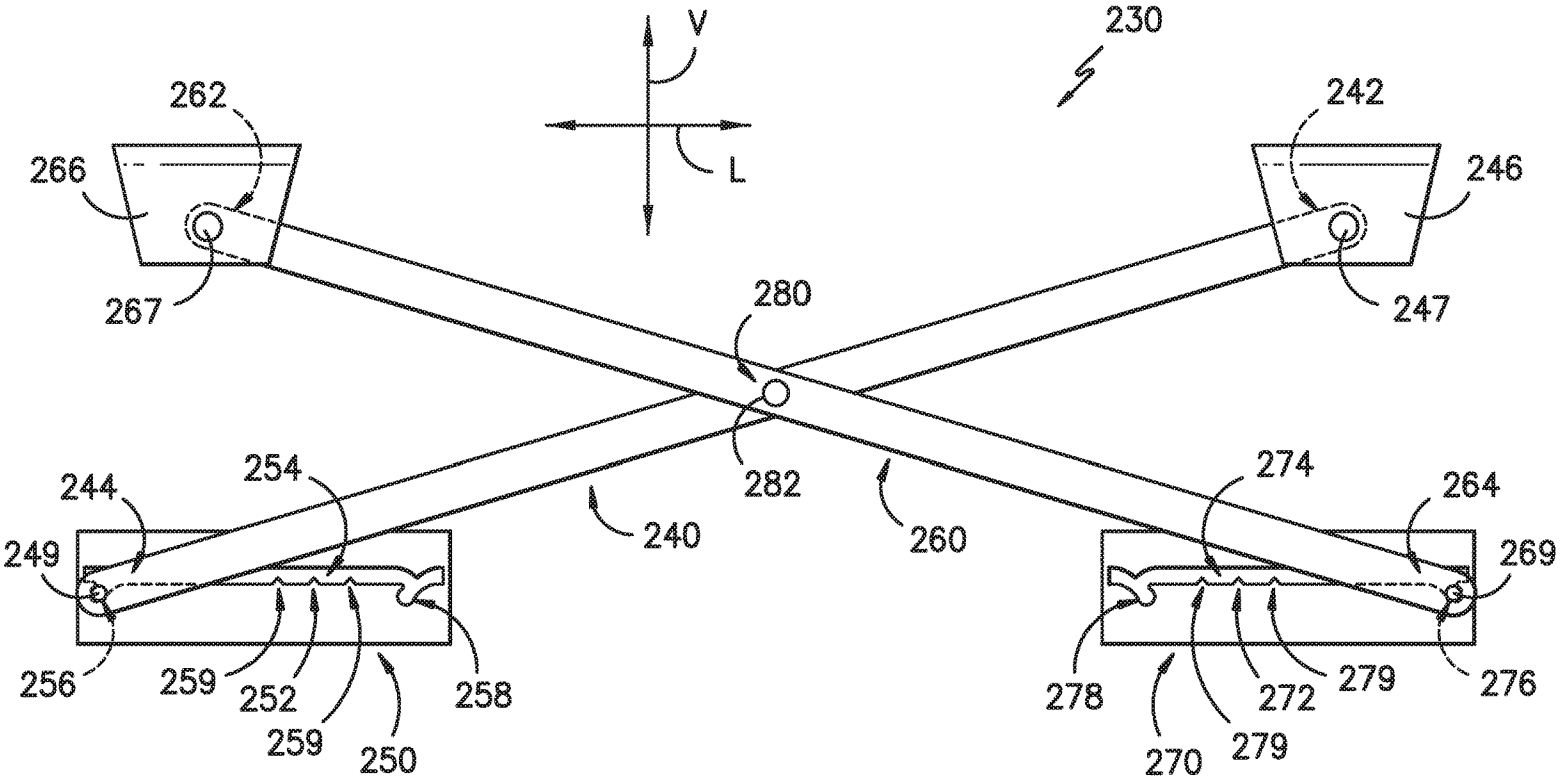
FIG. 4 provides a plan view of a lift assembly in accordance with embodiments of the present disclosure.
Figure 5:
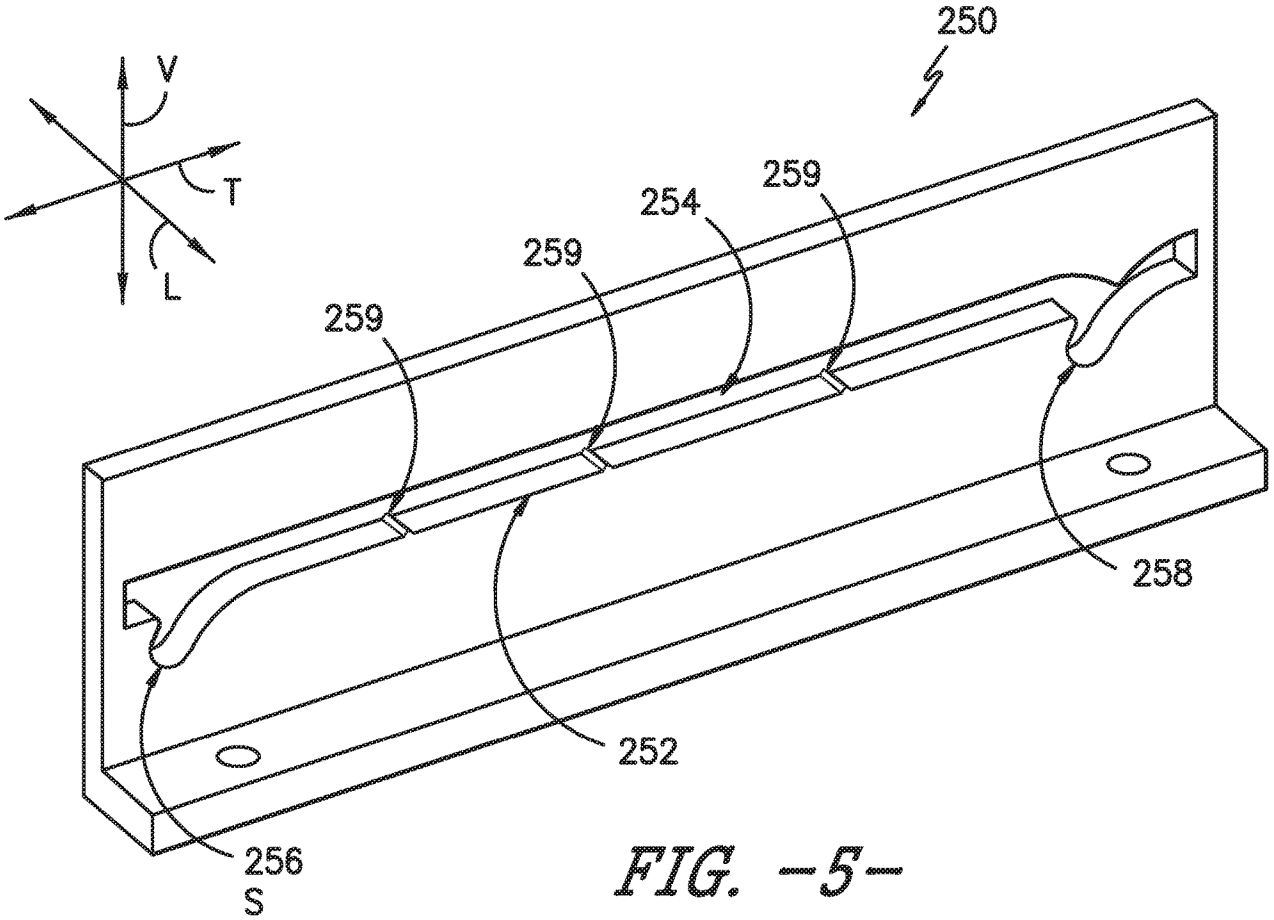
FIG. 5 provides a perspective view of a bracket in accordance with embodiments of the present disclosure.

Rack assembly 200 can also include a plurality of tines 220, which as shown are fixed tines but alternatively may be rotatable tines, for assisting with supporting articles within interior volume 206 of rack assembly 200. Tines 220 are mounted to bottom wall 210 of rack assembly 200 and extend into interior volume 206 of rack assembly 200, e.g., upwardly along the vertical direction V. In particular, as shown in FIG. 3, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 220 may be mounted or fixed (e.g., welded) to lateral members 212 and/or transverse members 214 of bottom wall 210 of rack assembly 200 and extend into interior volume 206 of rack assembly 200, e.g., upwardly along the vertical direction V, from bottom wall 210.

In exemplary embodiments, rack assembly 200 further includes one or more roller assemblies 136, each of which may include one or more wheels 137 and a carriage 138 which is generally connected to the wheels 137. One or more roller assemblies 136 may be positioned each sidewall 218, 219. The roller assemblies 136 may facilitate movement of the rack assembly 200 along the transverse direction T. For example, as illustrated, rack assembly 200 is movable along the transverse direction T between a retracted position (see FIG. 6) wherein the lower rack 132 is within the wash chamber 106 and an extended position (see FIGS. 7 and 8) wherein the lower rack 132 is positioned outside of the wash chamber 106. Wheels 137 may contact and roll along the inner surface of door 120 to move the rack assembly 200 along the transverse direction T as required.

Lower rack assembly 200 further includes one or more lift assemblies 230. Each lift assembly 230 may be connected to the lower rack 132 and may facilitate raising and lowering of the lower rack 132. For example, in exemplary embodiments, lower rack assembly 200 may include two lift assemblies 230; one lift assembly 230 may be disposed proximate and connected to the sidewall 218, and another lift assembly 230 may be disposed proximate and connected to the opposing sidewall 219. Each lift assembly 230 may further be connected to a roller assembly 136, to facilitate movement of the lower rack assembly 200 between the retracted and extended positions.

Lift assembly 230 may include a first arm 240, which may extend between a first end 242 and a second end 244. The first end 242 may, for example, be pivotally coupled to the lower rack 132, such as to a sidewall 218, 219 thereof. For example, a bracket 246 may extend between and connect the first end 242 and sidewall 218, 219. Bracket 246 may, as shown, be a J- or U-shaped bracket that contacts and connects to the sidewall 218, 219. A pin 247 may pivotally connect the first end 242 to the bracket 246. Accordingly, first arm 240 may be rotatable, such as within the vertical direction V-transverse direction T plane. Notably, the bracket 246 may additionally in some embodiments be movable (such as slidable) along the transverse direction T to facilitate raising and lowering of the lower rack 132 as discussed herein.

Lift assembly 230 may additionally include a first bracket 250, which may define a first slot 252. First bracket 250 may in exemplary embodiments be connected to a roller assembly 136 as shown. Second end 244 may be movably coupled to the slot 252. For example, a pin 249 may extend from the second end 244 through the slot 252, and be movable within the slot 252. Pin 249 may movably couple the second end 244 to the slot 252.

As illustrated, movement of the lower rack 132 along the vertical direction V causes movement of the second end 244 relative to the first slot 252 (and thus movement of the pin 249 within the slot 252) along the transverse direction T and pivotal rotation of the first end 242 (and thus rotation of the first arm 240). Such movement of the lower rack 132 can be movement to raise or lower the lower rack 132. For example, a user of the dishwasher appliance 100 may simply lift the rack 132 in the vertical direction V to raise the lower rack 132, or let down the rack 132 in the vertical direction V to lower the lower rack 132.

Figure 6:
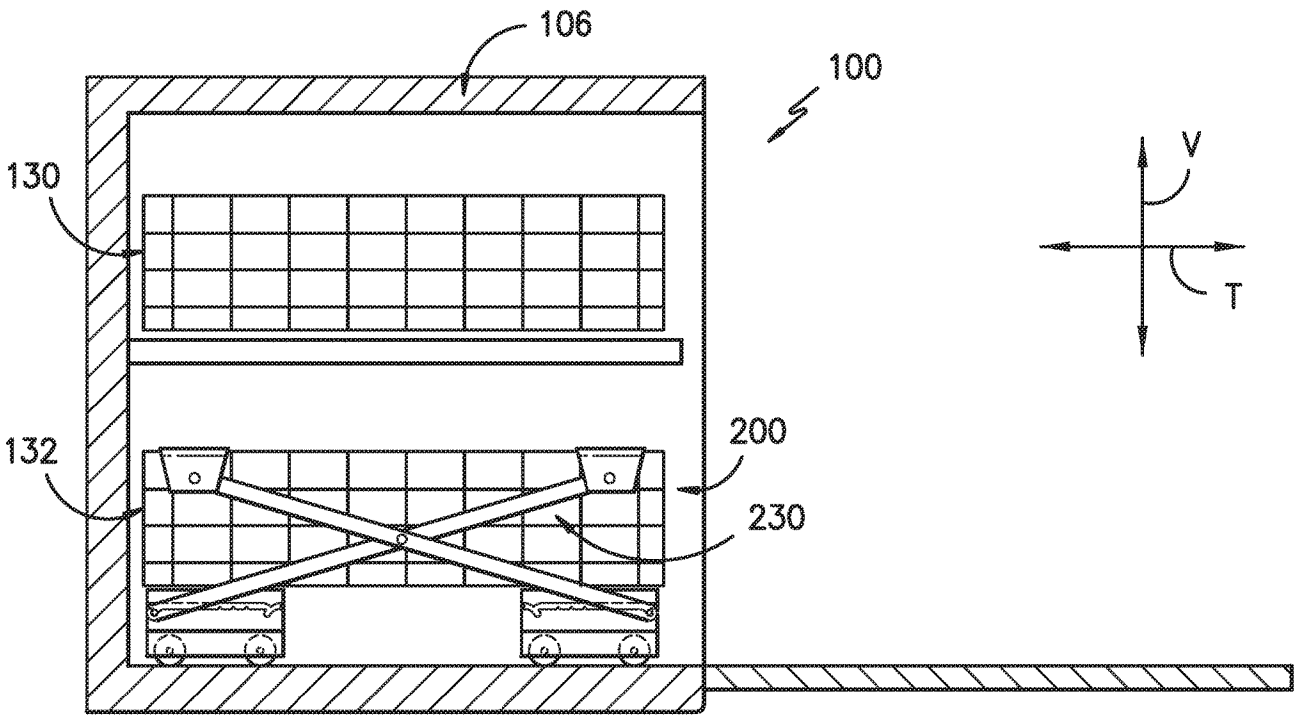
FIG. 6 illustrates a side sectional schematic view of a dishwasher appliance, with a lower rack assembly in a retracted, lowered position in accordance with embodiments of the present disclosure.
Figure 7:
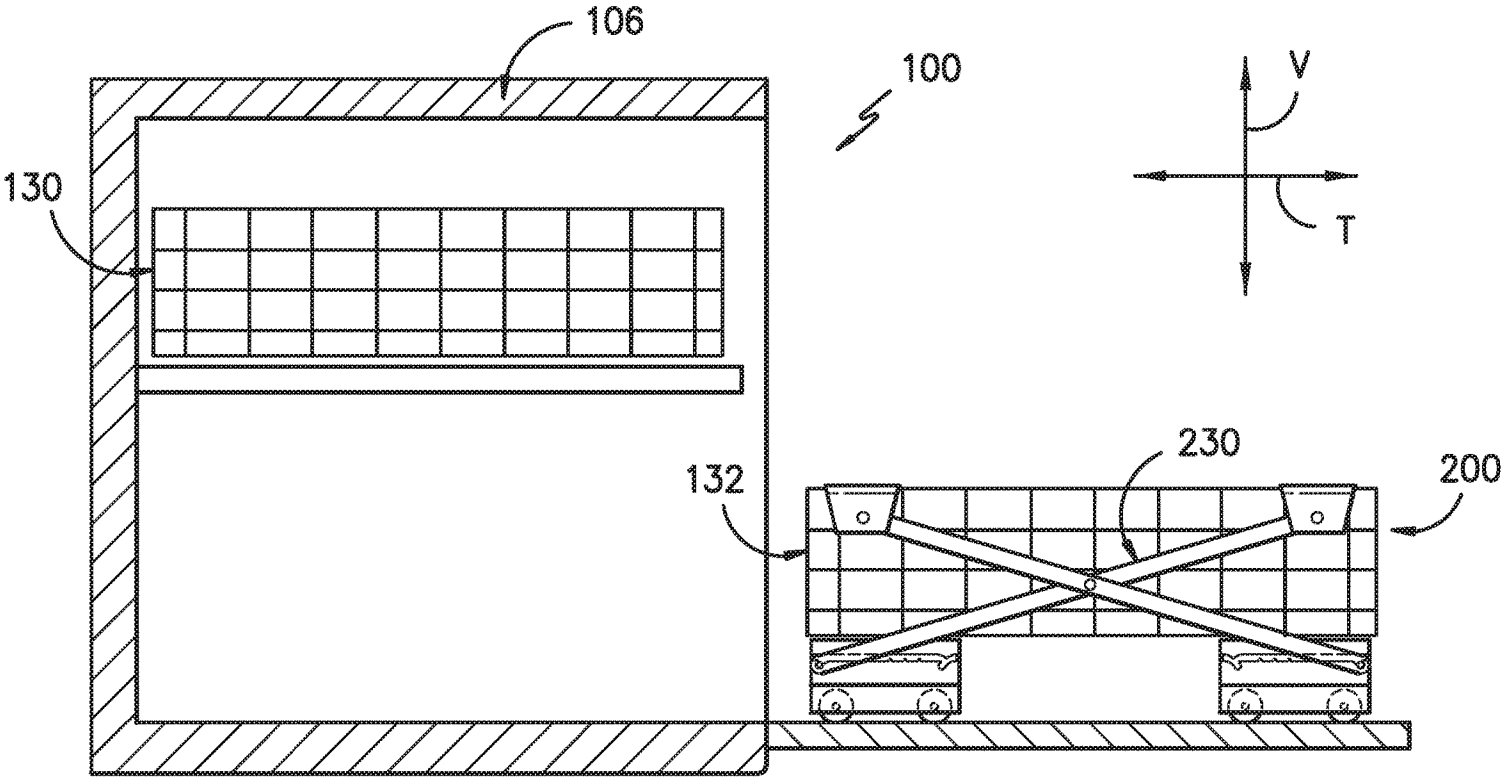
FIG. 7 illustrates a side sectional schematic view of a dishwasher appliance, with a lower rack assembly in an extended, lowered position in accordance with embodiments of the present disclosure.
Figure 8:
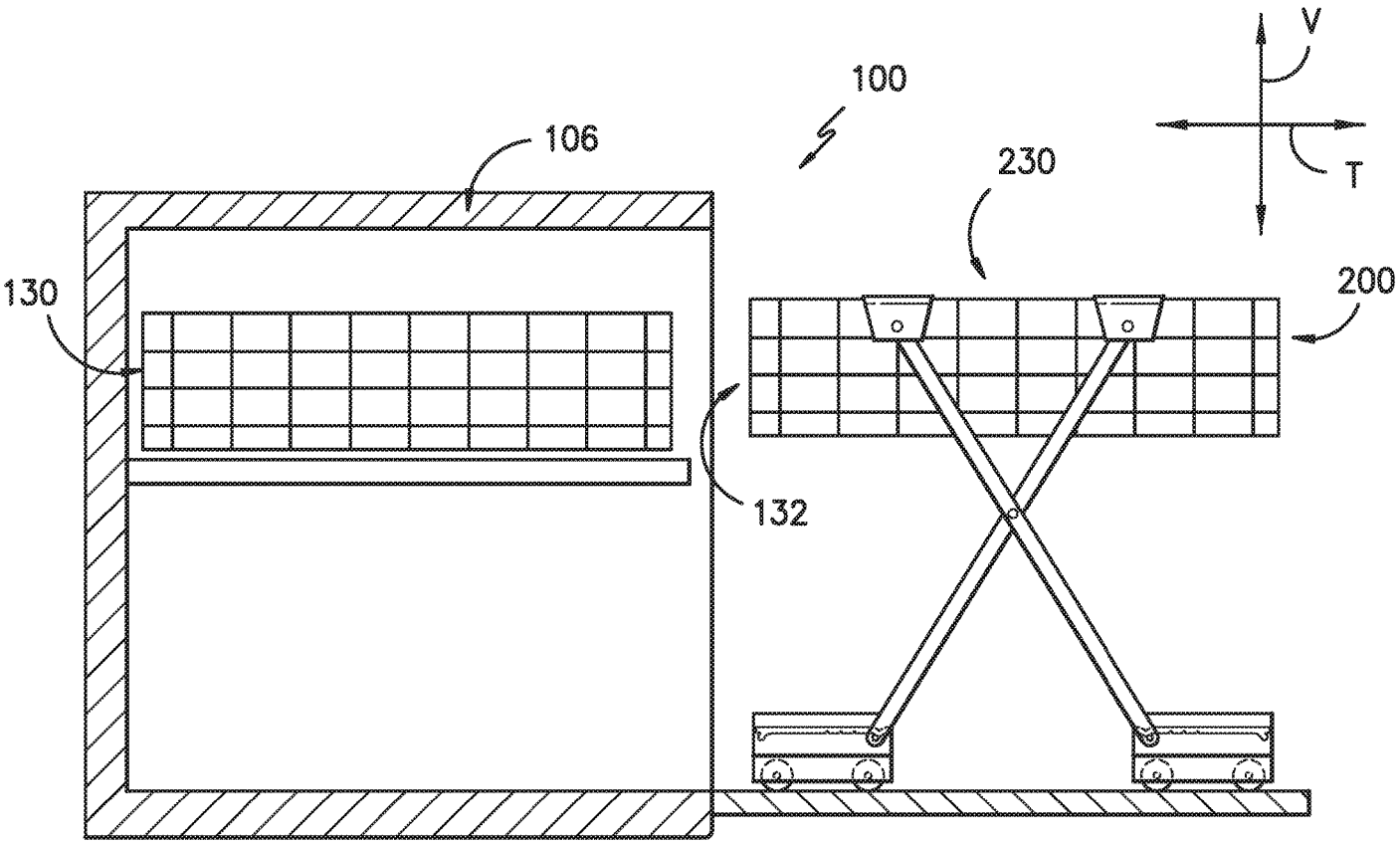
FIG. 8 illustrates a side sectional schematic view of a dishwasher appliance, with a lower rack assembly in an outer, raised position in accordance with embodiments of the present disclosure.

Lower rack 132 may be moved along the vertical direction V between a raised position (as illustrated in FIG. 8) and a lowered position (as illustrated in FIGS. 6 and 7). For example, the first slot 252 may include a main portion 254, a first branch 256 and a second branch 258. The first branch 256 and second branch 258 may each extend at an angle from the main portion 254. Further the first branch 256 and second branch 258 may be spaced apart from each other along the length of the main portion 254. In exemplary embodiments as shown, the main portion 254 may extend (such as in the vertical direction V-transverse direction T plane) along the transverse direction T. The first branch 256 and second branch 258 may each extend in a direction between the transverse direction T and the vertical direction V. The direction may be generally downward, as illustrated. An angle of between 30 and 60 degrees may, for example, be defined between each branch 256, 258 and the main portion 254.

In exemplary embodiments as illustrated, movement of the second end 244 to proximate the first branch 256 (and thus movement of the pin 249 into the first branch 256) may result in movement of the lower rack 132 along the vertical direction into a lowered position (see FIGS. 6 and 7). Further, movement of the second end 244 to proximate the second branch 258 (and thus movement of the pin 249 into the second branch 258) may result in movement of the lower rack 132 along the vertical direction into a raised position (see FIG. 8). For example, a user may exert a force on the lower rack 132 to move the lower rack 132 in an effort to position it in the raised position. This may cause movement of the second end 244 towards the second branch 258, and the pin 249 may move towards and into the second branch 258. When the second end 244 is proximate (and the pin 249 in) the second branch 258, the lower rack 132 may be in the raised position. Similarly, a user may exert a force on the lower rack 132 to move the lower rack 132 in an effort to position it in the lowered position. This may cause movement of the second end 244 towards the first branch 256, and the pin 249 may move towards and into the first branch 256. When the second end 244 is proximate (and the pin 249 in) the first branch 256, the lower rack 132 may be in the lowered position.

Lower rack 132 may, in some embodiments, additionally be moved to intermediate positions between the raised and lowered positions along the vertical direction V. For example, bracket 250 may further include one or more protrusions 259. Each protrusion 259 may extend into the first slot 252, such as into the main portion 254. The protrusions 259 may, for example, be spaced apart from each other along the transverse direction T, and may be positioned between the branches 256, 258. Protrusions 259 may serve to resist and/or arrest movement of the second end 244 relative to the first slot 252. For example, protrusions 259 may contact the pin 249 during movement of the pin within the main portion 254. Movement of the pin 249 may, in some embodiments, be stopped by a protrusion 259, such that the pin 249 contacts and comes to rest against the protrusion 259. Ceasing of such movement may advantageously cause the lower rack 132 to be positioned in an intermediate position between the raised and lowered positions. Continued movement of the second end 244 (and pin 249) after contact with a protrusion 259 may result from, for example, the user exerting a force on the lower rack 132 to continue movement of the rack 132.

Lift assembly 230 may additionally include a second arm 260, which may extend between a first end 262 and a second end 264. The first end 262 may, for example, be pivotally coupled to the lower rack 132, such as to a sidewall 218, 219 thereof. For example, a bracket 266 may extend between and connect the first end 262 and sidewall 218, 219. Bracket 266 may, as shown, be a J- or U-shaped bracket that contacts and connects to the sidewall 218, 219. A pin 267 may pivotally connect the first end 262 to the bracket 266. Accordingly, first arm 260 may be rotatable, such as within the vertical direction V-transverse direction T plane. Notably, the bracket 266 may additionally in some embodiments be movable (such as slidable) along the transverse direction T to facilitate raising and lowering of the lower rack 132 as discussed herein.

Lift assembly 230 may additionally include a second bracket 270, which may define a second slot 272. Second bracket 270 may in exemplary embodiments be connected to a roller assembly 136 as shown. Second end 264 may be movably coupled to the slot 272. For example, a pin 269 may extend from the second end 264 through the slot 272, and be movable within the slot 272. Pin 269 may movably couple the second end 264 to the slot 272.

As illustrated, movement of the lower rack 132 along the vertical direction V causes movement of the second end 264 relative to the second slot 272 (and thus movement of the pin 269 within the slot 272) along the transverse direction T and pivotal rotation of the first end 262 (and thus rotation of the second arm 260). Such movement of the lower rack 132 can be movement to raise or lower the lower rack 132. For example, a user of the dishwasher appliance 100 may simply lift the rack 132 in the vertical direction V to raise the lower rack 132, or let down the rack 132 in the vertical direction V to lower the lower rack 132.

Lower rack 132 may be moved along the vertical direction V between a raised position (as illustrated in FIG. 8) and a lowered position (as illustrated in FIGS. 6 and 7). For example, the second slot 272 may include a main portion 274, a first branch 276 and a second branch 278. The first branch 276 and second branch 278 may each extend at an angle from the main portion 274. Further the first branch 276 and second branch 278 may be spaced apart from each other along the length of the main portion 274. In exemplary embodiments as shown, the main portion 274 may extend (such as in the vertical direction V—transverse direction T plane) along the transverse direction T. The first branch 276 and second branch 278 may each extend in a direction between the transverse direction T and the vertical direction V. The direction may be generally downward, as illustrated. An angle of between 30 and 60 degrees may, for example, be defined between each branch 276, 278 and the main portion 274.

In exemplary embodiments as illustrated, movement of the second end 264 to proximate the first branch 276 (and thus movement of the pin 269 into the first branch 276) may result in movement of the lower rack 132 along the vertical direction into a lowered position (see FIGS. 6 and 7). Further, movement of the second end 264 to proximate the second branch 278 (and thus movement of the pin 269 into the second branch 278) may result in movement of the lower rack 132 along the vertical direction into a raised position (see FIG. 8). For example, a user may exert a force on the lower rack 132 to move the lower rack 132 in an effort to position it in the raised position. This may cause movement of the second end 264 towards the second branch 278, and the pin 269 may move towards and into the second branch 278. When the second end 264 is proximate (and the pin 269 in) the second branch 278, the lower rack 132 may be in the raised position. Similarly, a user may exert a force on the lower rack 132 to move the lower rack 132 in an effort to position it in the lowered position. This may cause movement of the second end 264 towards the first branch 276, and the pin 269 may move towards and into the first branch 276. When the second end 264 is proximate (and the pin 269 in) the first branch 276, the lower rack 132 may be in the lowered position.

Lower rack 132 may, in some embodiments, additionally be moved to intermediate positions between the raised and lowered positions along the vertical direction V. For example, bracket 270 may further include one or more protrusions 279. Each protrusion 279 may extend into the second slot 272, such as into the main portion 274. The protrusions 279 may, for example, be spaced apart from each other along the transverse direction T, and may be positioned between the branches 276, 278. Protrusions 279 may serve to resist and/or arrest movement of the second end 264 relative to the second slot 272. For example, protrusions 279 may contact the pin 269 during movement of the pin within the main portion 274. Movement of the pin 269 may, in some embodiments, be stopped by a protrusion 279, such that the pin 269 contacts and comes to rest against the protrusion 279. Ceasing of such movement may advantageously cause the lower rack 132 to be positioned in an intermediate position between the raised and lowered positions. Continued movement of the second end 264 (and pin 269) after contact with a protrusion 279 may result from, for example, the user exerting a force on the lower rack 132 to continue movement of the rack 132.

In exemplary embodiments as illustrated, the first arm 240 and second arm 260 are generally arranged and move in a "scissors" style. For example, the first arm 240 and second arm 260 may be pivotally connected at a pivot point 280, such as by a pin 282. The pivot point 280 and pin 282 may be located between the first and second ends 242, 244 of the first arm 240 (along the length of the first arm 240) and between the first and second ends 262, 264 of the second arm 260 (along the length of the second arm 260). Notably, the pivot pint 280 may, in some embodiments, be movable (such as slidable) along the lengths of the first arm 240 and second arm 260 to facilitate raising and lowering of the lower rack 132 as discussed herein.

Notably, in exemplary embodiments due to the arrangement of the first and second arms 240, 260, the first bracket 250 and second bracket 270 may have opposite orientations. Second ends 244, 264 may move towards each other, such as along the transverse direction T, when the rack 132 is being moved to the raised position. Similarly, second ends 244, 264 may move away from each other, such as along the transverse direction T, when the rack 132 is being moved to the lowered position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical, a lateral, and a transverse direction, the dishwasher appliance comprising:

a wash tub that defines a wash chamber;

a fluid circulation assembly for providing a fluid flow within the wash chamber; and a lower rack assembly, the lower rack assembly comprising:

a lower rack configured for receipt of articles for washing;

a lift assembly connected to the lower rack, the lift assembly comprising:

a first arm extending between a first end and a second end, the first end of the first arm pivotally coupled to the lower rack;

a first bracket defining a first slot, the second end of the first arm movably coupled to the first slot;

wherein movement of the lower rack along the vertical direction causes movement of the second end of the first arm relative to the first slot along the transverse direction and pivotal rotation of the first end of the first arm;

wherein the first slot comprises a main portion, a first branch extending at an angle different from the main portion, and a second branch extending at an angle different from the main portion, the second branch spaced apart from the first branch along the transverse direction; and wherein movement of the second end of the first arm to proximate the first branch results in movement of the lower rack along the vertical direction into a lowered position, and movement of the second end of the first arm to proximate the second branch results in movement of the lower rack along the vertical direction into a raised position, the raised position above the lowered position along the vertical direction.

2. The dishwasher appliance of claim 1, wherein the main portion extends along the transverse direction, the first branch extends between the transverse direction and the vertical direction, and the second branch extends between the transverse direction and the vertical direction.

3. The dishwasher appliance of claim 1, wherein the bracket further comprises a plurality of protrusions, each of the plurality of protrusions extending into the first slot.

4. The dishwasher appliance of claim 3, wherein each of the plurality of protrusions extends into the main portion.

5. The dishwasher appliance of claim 3, wherein the plurality of protrusions are spaced apart from each other along the transverse direction.

6. The dishwasher appliance of claim 1, wherein the lower rack assembly is movable along the transverse direction between a retracted position wherein the lower rack is within the wash chamber and an extended position wherein the lower rack is positioned outside of the wash chamber.

7. The dishwasher appliance of claim 1, wherein the lower rack assembly further comprises a roller assembly, the roller assembly comprising a plurality of wheels.

8. The dishwasher appliance of claim 7, wherein the first bracket is connected to the roller assembly.

9. The dishwasher appliance of claim 1, wherein the lift assembly further comprises:

a second arm extending between a first end and a second end, the first end of the second arm pivotally coupled to the lower rack;

a second bracket defining a second slot, the second end of the second arm movably coupled to the second slot;

wherein movement of the lower rack along the vertical direction causes movement of the second end of the second arm relative to the second slot along the transverse direction and pivotal rotation of the first end of the second arm.

10. The dishwasher appliance of claim 9, wherein the first arm and the second arm are pivotally coupled at a pivot point, the pivot point located between the first end and the second end of the first arm and between the first end and the second end of the second arm.

11. The dishwasher appliance of claim 1, further comprising an upper rack.

12. The dishwasher appliance of claim 1, wherein the lift assembly is a plurality of lift assemblies.

13. A lower rack assembly for a dishwasher appliance, the lower rack assembly comprising:

a lower rack configured for receipt of articles for washing;

a lift assembly connected to the lower rack, the lift assembly comprising:

a first arm extending between a first end and a second end, the first end of the first arm pivotally coupled to the lower rack;

a first bracket defining a first slot, the second end of the first arm movably coupled to the first slot;

wherein movement of the lower rack along the vertical direction causes movement of the second end of the first arm relative to the first slot along the transverse direction and pivotal rotation of the first end of the first arm;

wherein the first slot comprises a main portion, a first branch extending at an angle different from the main portion, and a second branch extending at an angle different from the main portion, the second branch spaced from the first branch along the transverse direction; and wherein movement of the second end of the first arm to proximate the first branch results in movement of the lower rack along the vertical direction into a lowered position, and movement of the second end of the first arm to proximate the second branch results in movement of the lower rack along the vertical direction into a raised position, the raised position above the lowered position along the vertical direction.

14. The lower rack assembly of claim 13, wherein the main portion extends along the transverse direction, the first branch extends between the transverse direction and the vertical direction, and the second branch extends between the transverse direction and the vertical direction.

15. The lower rack assembly of claim 13, wherein the bracket further comprises a plurality of protrusions, each of the plurality of protrusions extending into the first slot.

16. The lower rack assembly of claim 13, further comprising a roller assembly, the roller assembly comprising a plurality of wheels.

* * * * *